US005326285A

United States Patent [19]

Maros

[11] Patent Number: 5,326,285

[45] Date of Patent: Jul. 5, 1994

[54] CONNECTION ARRANGEMENT BETWEEN TERMINAL BLOCKS

[75] Inventor: Ronald R. Maros, Itasca, Ill.

[73] Assignee: Cooper Industries, Inc., Houston, Tex.

[21] Appl. No.: 989,670

[22] Filed: Dec. 14, 1992

[51] Int. Cl.[5] ..... H01R 9/22

[52] U.S. Cl. ..... 439/717; 439/709

[58] Field of Search ..... 439/712, 713, 714, 717, 439/715, 709, 710, 723, 724

[56] References Cited

U.S. PATENT DOCUMENTS

| | | | |
|---|---|---|---|
| 2,851,671 | 9/1958 | Luce | 439/723 |
| 3,315,215 | 4/1967 | Kulka | 439/717 |
| 3,771,104 | 11/1973 | Clark | 439/717 |
| 3,980,383 | 9/1976 | Dickey et al. | 439/709 |
| 4,407,559 | 10/1983 | Meyer | 439/709 |
| 4,630,882 | 12/1986 | Naylor et al. | 439/709 |
| 4,790,763 | 12/1988 | Weber et al. | 439/717 |
| 4,886,464 | 12/1939 | Utena, Jr. | 439/709 |

FOREIGN PATENT DOCUMENTS

| | | | |
|---|---|---|---|
| 8500043 | 8/1986 | Netherlands | 439/717 |

*Primary Examiner*—Larry I. Schwartz
*Assistant Examiner*—Hien D. Vu
*Attorney, Agent, or Firm*—William B. Patterson; Eddie E. Scott; Nelson A. Blish

[57] ABSTRACT

A connection system between terminal blocks whereby one block has an extension and one block has a mating pocket. Upon connection, the various surfaces of the extension and pocket cause a frictional relationship between the blocks and maintain a uniform distance between the termination points around the connection.

3 Claims, 1 Drawing Sheet

CONNECTION ARRANGEMENT BETWEEN TERMINAL BLOCKS

BACKGROUND OF INVENTION

The present invention relates to terminal blocks for use with electrical equipment; more particularly, the invention relates to a means of connection between two or more terminal blocks in order to produce a larger capacity block without increased costs associated with manufacturing a one-piece block.

Terminal blocks provide a point of termination for wires coming from one piece of electrical equipment and extending on to another piece of equipment. Typically, the blocks include a number of studs with an attachment means like a nut at each end of the stud. The studs are spaced apart at a uniform distance to prevent "creeping" of electrical voltage.

A typical use for a terminal block is between a programmable controller and the equipment to be controlled. Another use is with ground fault equipment. The number of studs required in the block vary widely depending upon the application. For example, some applications require a terminal block with as many as twenty separate termination points. Because the terminal blocks are often injection molded and the studs must be separated from each other, economics limits the number of studs in a single block. For example, a block housing twenty studs would require all new tooling in an injection mold machine set up to produce terminal blocks having an eighteen hole maximum. Connecting two separate terminal blocks together can provide a block with the required number of termination points while avoiding problems associated with making one block. However, any such connection must not only connect the blocks but must also maintain the desired distance between the termination points on either side of the connection.

There is a need therefore, for terminal blocks that can be mated together thereby providing any number of terminals and eliminating the costs associated with manufacturing separate blocks of various lengths.

There is a further need therefore, for terminal blocks that can be mated together whereby the desired distance between all termination points on the mated blocks is maintained.

SUMMARY OF INVENTION

The present invention provides a means of connecting two or more terminal blocks thereby eliminating the costs associated with manufacturing a one-piece block with a given number of termination points. According to the invention, one block is produced with an extension at one end and another block is produced with a mating pocket at one end. The two blocks are then fitted together in a frictional relationship. The connection means retains the uniform distance between the termination points on either side of the connection.

DESCRIPTION OF AN EMBODIMENT

Figure 1:
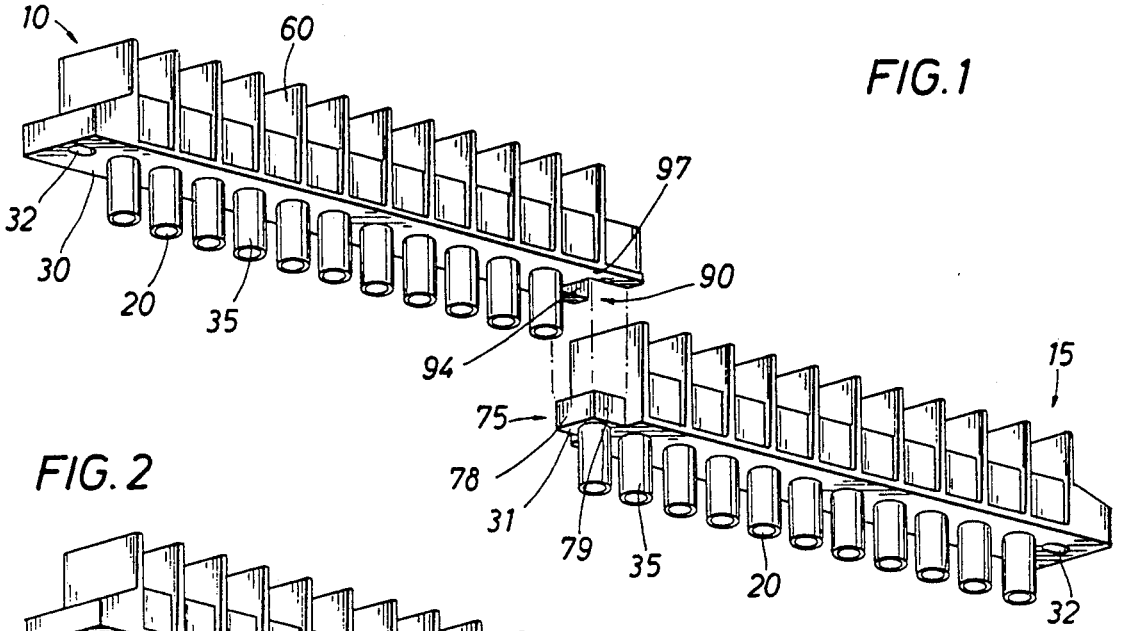
FIG. 1 depicts two separate terminal blocks having the connection arrangement that is the subject of the present invention.
Figure 3:
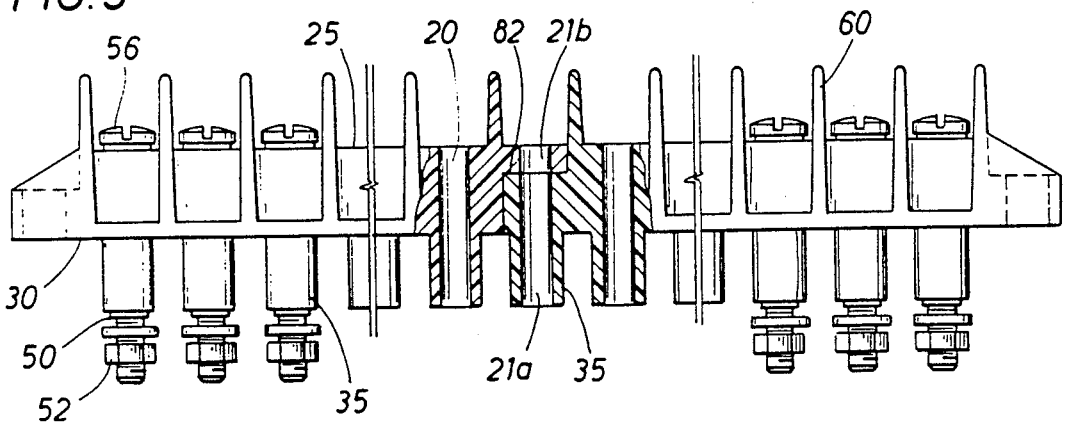
FIG. 3 is a side view of the connected terminal blocks.

The connection system of the present invention can be best understood by reference to the Figures. FIG. 1 shows two terminal blocks 10, 15. Each block is constructed with a given number of terminal apertures 20 which are equally spaced. In the preferred embodiment, apertures 20 are flush with the top surface 25 of the terminal blocks (FIG. 3). At the bottom surface 30 of the block, apertures 20 terminate in cylindrically shaped sleeves 35. At one end of each block is a mounting hole 32 which can be used to secure the blocks once they are connected together. In the preferred embodiment, the terminal blocks are made of a thermoplastic material and manufactured by an injection molding process.

Terminal apertures 20 are designed to accept metallic studs 50 which extend the length of the apertures 20 and serve as a conductor and termination point for wires leading into and away from the terminal blocks (FIG. 3). Typically, the studs 50 will include a nut 52 or a screw 56 at each end, allowing a wire (not shown) to be mechanically and electrically connected to stud 50. As further depicted in FIG. 3, the top surface 25 of the blocks is equally divided by barriers 60. The barriers 60 prevent voltage from creeping between studs 50 and use of the barriers reduces the distance required between studs 50. As the wires extend from cylindrical sleeves 35 at the bottom surface 30 of the block, they can be covered in shrink-type rubber or studs 50 and can extend directly into a printed circuit board (not shown) thus eliminating the need for wires.

Figure 4:
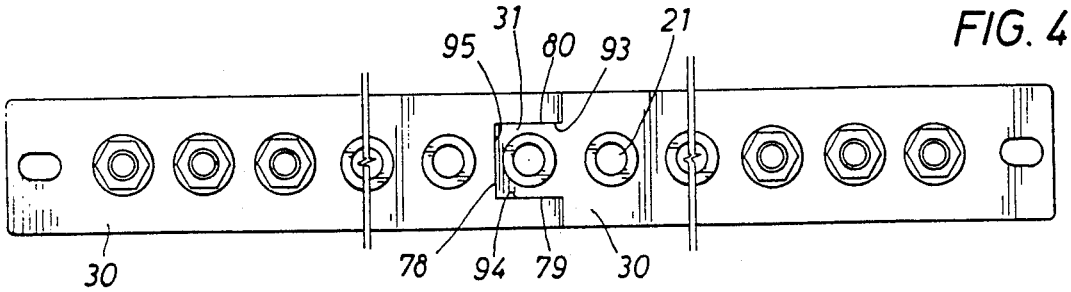
FIG. 4 is a bottom view of the connected terminal blocks.

The present invention resides within the connection system between the two blocks 10 and 15. Block 15 is equipped at one end with an extension 75 which, in the preferred embodiment, is rectangular in shape with three exposed sides 78, 79, 80 (FIG. 4). Formed into extension 75 is a lower terminal aperture **21*a* (FIG. 3) complete with sleeve 35 extending from a bottom surface 31 of extension 75. Bottom surface 31 is flush with the bottom surface 30 of block 10. Terminal aperture 21*a* extends through extension 75, terminating at surface 82 at the top of extension 75. Extension 75 is designed whereby terminal aperture 21*a* in extension 75 is a uniform distance from the nearest termination aperture 20 in the body 15**.

The other block 10 has a mating pocket 90 formed by interior surfaces 93, 94, 95 that are designed to mate with surfaces 78, 79, and 80 in block 15 (FIG. 4). Surrounding pocket 90 is surface 97 which is flush with the bottom surface 30 of the block 10. The top surface 97 of pocket 90 includes an upper terminal aperture **21*b* which is designed to align with terminal aperture 21*a* formed into extension 75**.

When extension 75 is pushed into pocket 90 surfaces 79 and 80 on either side of extension 75 are held in a frictional relationship between surfaces 93 and 94 of pocket 90. Additionally, surface 78 of extension 75 abuts surface 95 of pocket 90 causing terminal apertures **21*a* & 21*b* to be aligned (FIG. 4). Upon insertion of stud 50 through apertures 21*a* and 21*b*, any misalignment between 21*a* and 21*b* is corrected. Also, as a result of the various mating surfaces, the aperture created by 21*a* and 21*b* is a uniform distance from the adjacent apertures 20**.

Figure 2:
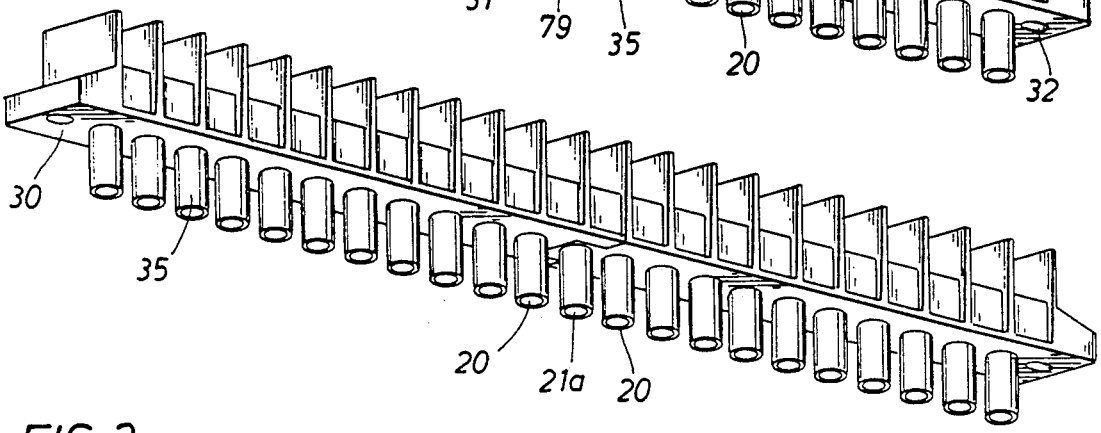
FIG. 2 depicts the two terminal blocks having been connected together with the connection arrangement of the present invention.

FIG. 2 illustrates the blocks 10, 15 after they have been connected using the connection system of the present invention. The terminal aperture created by 21*a* & 21*b* is a uniform distance away from the adjacent terminal apertures 20, thereby retaining the distance required between all apertures 20 to prevent creeping of voltage. Additionally the bottom surface 30 of each block are level. In the preferred embodiment, the frictional relationship between the mating portions of the blocks holds blocks 10, 15 together until each block is anchored through mounting hole 32.

The terminal block connection of the present invention solves the problem presented when a terminal block is required with a large number of termination points. The invention provides a connection between terminal blocks wherein the tolerance between termination points is maintained and further allows a block with any number of termination points to be produced without the need to make a one-piece terminal block.

While the terminal block connection system of the present invention has been described by reference to its preferred embodiment, it will be understood that other various embodiments of the device may be possible by reference to the specification and the appended claims. For example, in the preferred embodiment, the connection means includes an extension which makes up the bottom portion of the connection and fits into a pocket above it. However, the invention could be practiced whereby the extension makes up the upper portion of the connection and fits into a pocket formed below it. Those skilled in the art will appreciate that such alternative arrangements are within the purview of the invention.

Additionally, the connection means could be comprised of two rectangular shaped extensions formed on a first block and a single rectangular shaped extension formed on a second block which is arranged to fit in frictional relationship between the two extensions on the first block. Apertures formed in each of the three extensions would, upon connection, align to allow the insertion of a stud through all three extensions. Such additional embodiments shall be included within the scope of the appended claims.

I claim:

1. A mating pair of electrical terminal blocks, said terminal blocks comprising:

a first block;

a mating block, said first and mating blocks including:

a top surface;

a bottom surface;

a plurality of equally spaced apertures, said apertures extending from said top surface to said bottom surface and terminating at said bottom surface in a cylindrically shaped tube;

a plurality of substantially rectangular barriers, said barriers spaced between said apertures; and connection means integral with said first and mating blocks whereby, upon connection, said connection means form a first aperture and all of said apertures within said connection means, first block and said mating block are equally spaced from each other.

2. The mating pair of terminal blocks in claim 1, wherein said connection means includes:

an extension at a proximal end of said first block, said extension including:

two outwardly facing parallel sides, a front surface and a top surface, said top surface having an upper aperture centered therein, said first aperture extending through said extension to said bottom surface and extending from said bottom surface forming a hollow cylinder therefrom.

3. The mating pair of terminal blocks in claim 2, wherein said connection means further includes:

a pocket formed in said mating block, said pocket including two inwardly facing parallel sides, a rear surface and a top surface, said top surface having a lower aperture centered therein, said second aperture extending through said mating terminal block to said top surface of said mating terminal block, said lower aperture constructed and arranged to align with said upper aperture to form said first aperture upon connection of said first and mating blocks.

* * * * *